US008864468B1

(12) United States Patent
Liang

(10) Patent No.: US 8,864,468 B1
(45) Date of Patent: Oct. 21, 2014

(54) TURBINE STATOR VANE WITH ROOT TURN PURGE AIR HOLE

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 449 days.

(21) Appl. No.: 13/458,322

(22) Filed: Apr. 27, 2012

(51) Int. Cl.
*F01D 5/18* (2006.01)

(52) U.S. Cl.
USPC ..... 416/97 R; 415/115; 415/116; 416/97 A; 416/96 R; 416/96 A

(58) Field of Classification Search
USPC .... 415/115, 116; 416/97 R, 97 A, 96 R, 96 A
See application file for complete search history.

(56) References Cited

U.S. PATENT DOCUMENTS

| | | | | | |
|---|---|---|---|---|---|
| 5,498,126 | A * | 3/1996 | Pighetti et al. | ..... | 415/115 |
| 5,827,043 | A * | 10/1998 | Fukuda et al. | ..... | 415/115 |
| 7,118,325 | B2 * | 10/2006 | Kvasnak et al. | ..... | 415/115 |
| 8,221,055 | B1 * | 7/2012 | Liang | ..... | 415/115 |
| 8,757,961 | B1 * | 6/2014 | Liang | ..... | 415/115 |
| 8,821,111 | * | 9/2014 | Gear et al. | ..... | 415/115 |

* cited by examiner

*Primary Examiner* — Igor Kershteyn
(74) *Attorney, Agent, or Firm* — John Ryznic

(57) ABSTRACT

An turbine stator vane for an industrial engine, the vane having a serpentine flow cooling circuit with a first leg located along a leading edge of the vane airfoil and a partition rib separating the first leg from a second leg. A root turn channel connects the first leg to the second leg. A lower end of the partition rib includes a guide vane that directs cooling air from an aft section of the first leg toward a bleed hole for purging an ISSH. A plurality of turning guide ribs located in the aft section of the first leg also directs the cooling air toward the bleed hole.

7 Claims, 4 Drawing Sheets view A-A

TURBINE STATOR VANE WITH ROOT TURN PURGE AIR HOLE

CROSS-REFERENCE TO RELATED APPLICATIONS

None.

GOVERNMENT LICENSE RIGHTS

None.

BACKGROUND OF THE INVENTION

1. Field of the Invention

The present invention relates generally to a gas turbine engine, and more specifically to a turbine stator vane with a purge air hole for an inter-stage seal housing.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

A turbine stator vane will include an internal cooling air circuit to provide cooling for the airfoil and the endwalls as well as a forward and an aft purge air hole to provide purge air to an inter-stage seal housing and an aft rim cavity. FIG. 4 shows a prior art stator vane with a number of bleed of holes located at an end of the leading edge serpentine flow channel that provides purge air for inter-stage seal housing (ISSH). FIG. 5 shows a prior art stator vane with a purge air hole located at a bottom of the inner diameter root turn. In both of these prior art designs, the air used to purge the ISSH is hot air that travels along the leading edge region of the airfoil which is the hotte4st surface of the airfoil.

BRIEF SUMMARY OF THE INVENTION

A turbine stator vane for an industrial engine includes a serpentine flow cooling circuit with a first leg located along a leading edge of an airfoil of the vane, where the first leg includes trip strips on a forward section of the leg with the aft section having a smooth wall surface so that heat transfer to the cooling air flowing in the aft section will be cooler. A guide vane formed on an end of a partition rib guide the cooler cooling air toward a bleed hole located at a junction between the first leg and a root turn channel that opens into an inter-stage seal housing or ISSH. A plurality of turning guide vanes is formed in the first leg in the aft section and direct the cooler air toward the bleed hole.

The cooler air flowing along the aft section of the first leg will be mixed with the hotter cooling air from the forward section to produce a cooler cooling air that is used for the bleed hole to purge the ISSH.

The turning guide vanes extend from the pressure side wall surface or the suction side wall surface of the first leg and form a gap between guide vanes where the gap progressively increases in a direction away from the partition rib. The turning guide vanes have a cascade and staggered formation.

DETAILED DESCRIPTION OF THE INVENTION

The present invention is a turbine stator vane for an industrial gas turbine engine that includes purge air holes for purge air in an inter-stage seal housing (ISSN) and an aft rim cavity of the turbine. the purge air holes of the present invention are idea for use in new stator vanes that have larger airfoils in which the cooling channels are much larger in cross sectional flow area than prior art industrial engine stator vanes.

Figure 1:
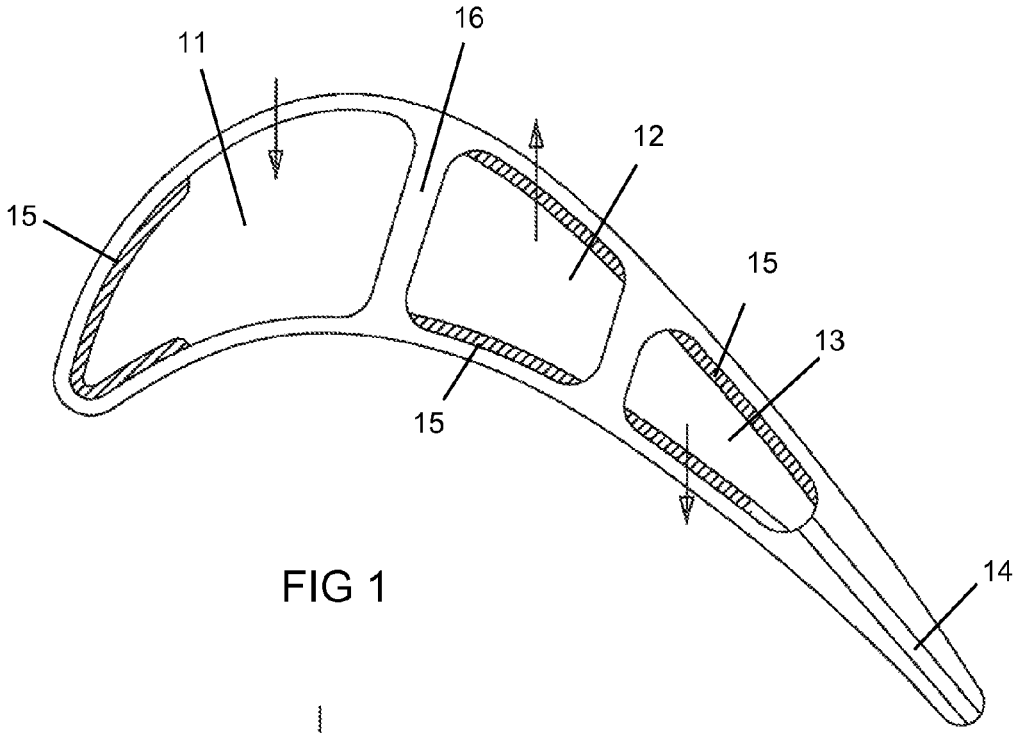
FIG. 1 shows a cross section top view of a stator vane cooling circuit for the present invention.
Figure 3:
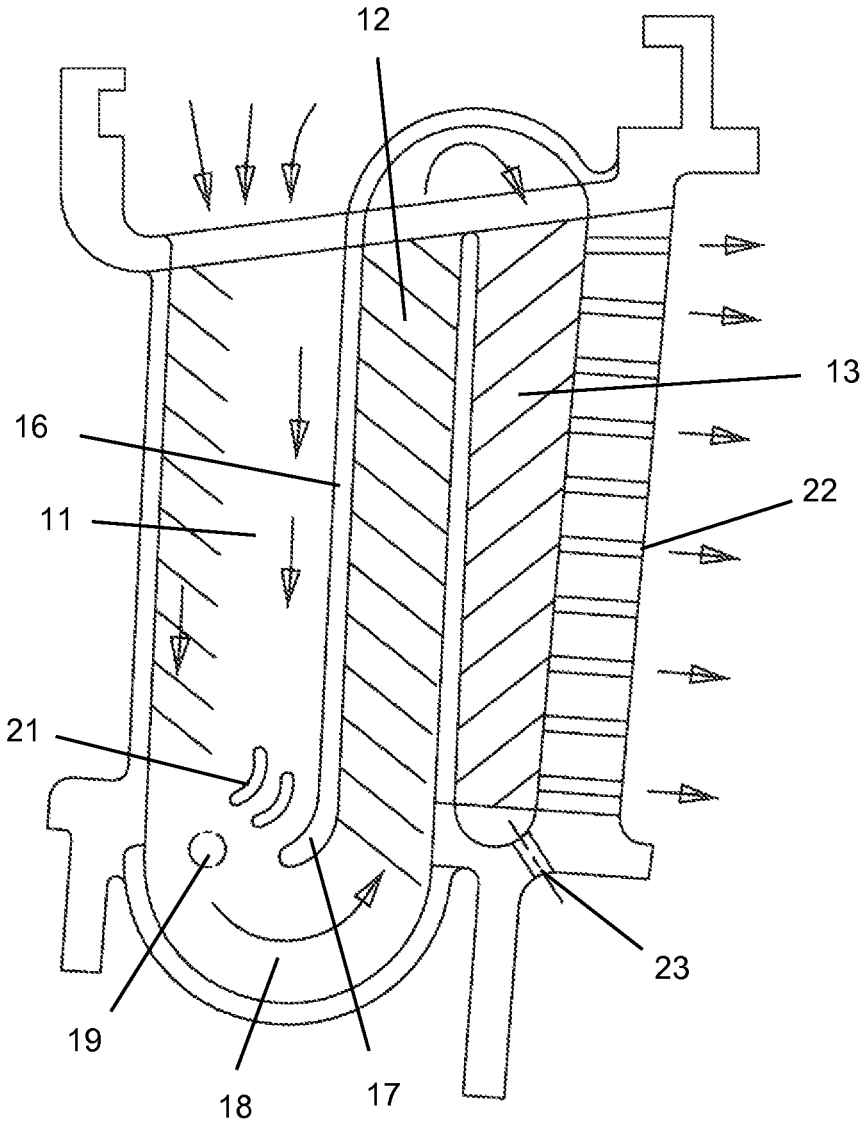
FIG. 3 shows a cross section side view of a stator vane cooling circuit with bleed holes for the present invention.
Figure 4:
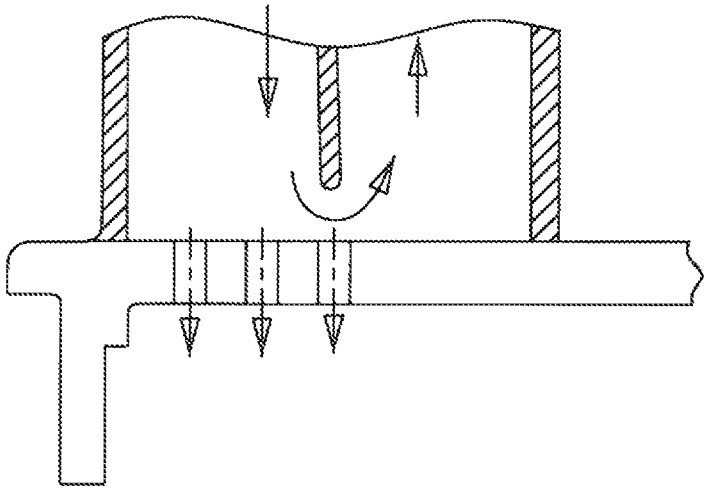
FIG 4 Prior Art
FIGS. 4 and 5 show cross section side views of two purge air holes in stator vanes for the prior art vanes.
Figure 5:
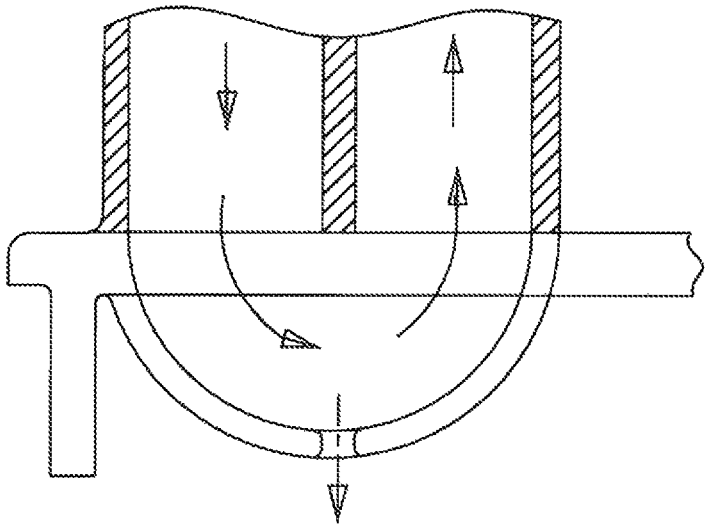
FIG 5 Prior Art

FIG. 1 shows a cross section top view of the stator vane with the cooling circuit of the present invention. The vane is cooled with a three-pass serpentine flow cooling circuit having the first leg 11 located along the leading edge region of the vane. The leading edge cooling channel or first leg 11 includes trip strips 15 located along a forward section of the channel or leg only with the aft section of the channel being smooth and without trip strips as seen in FIGS. 1 and 3. With this design, the cooling air flowing down the channel along the aft side will not be heated as much as if trip strips were used. The hottest section of the airfoil is along the leading edge. Thus, the trip strips used along the forward section of the leading edge channel will heat up the cooling air flowing along the forward section more than along the aft section.

Figure 2:
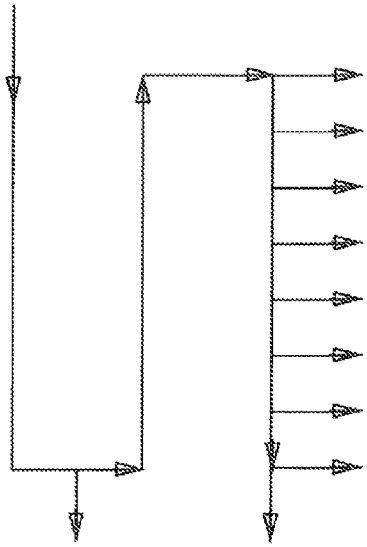
FIG. 2 shows a flow diagram for the stator vane of FIG. 1 according to the present invention.

The second leg 12 and third leg 13 of the serpentine flow circuit both include trip strips 15 along the entire two side walls of the channels for maximizing the heat transfer rate from the hot metal surfaces to the cooling air flowing through the channels or legs. FIG. 2 shows a flow diagram for the vane cooling air circuit of FIG. 1 along with trailing edge exit holes and a forward and aft rim cavity purge hole on the lower diameter of the vane.

FIG. 3 shows a side view of the vane with the cooling air circuit of the present invention. The first leg 11 or leading edge cooling channel includes the trip strips 15 on the forward section with the aft section being a smooth wall surface to minimize heat transfer from the hot metal to the cooling air flowing along the aft section of the channel 11. At a lower end of the first leg 11, the rib 16 separating the first leg 11 from the second leg 12 turns inward 17 or toward the forward side of the channel to direct the cooler cooling air from the aft section of the first leg toward a bleed hole 19 located at an entrance to the lower diameter root turn channel 18. The turn rib 17 directs the cooler cooling air from the first leg 11 toward the bleed hole 19 to be mixed with the hotter cooling air from the forward section of the first leg 11. Additional curved guide ribs 21 are used at an end of the first leg 11 to direct the cooler cooling air from the aft section of the first leg to be mixed with the hotter cooling air and then discharged through the bleed hole to purge the ISSH with cooler purge air than in the prior art designs.

As seen in FIG. 3, the cooling air from the root turn channel 18 that is not discharged through the bleed hole 19 will flow up into the second leg 12 and through the outer root turn channel and then into the third leg 13. A row of discharge exit hole 22 located along the trailing edge of the airfoil is connected to the third leg 13 to discharge cooling air for cooling of the trailing edge region of the vane. An aft rim cavity purge hole 23 is located at an end of the third leg 13 and discharges any remaining cooling air into the aft rim cavity as purge air.

Figure 6:
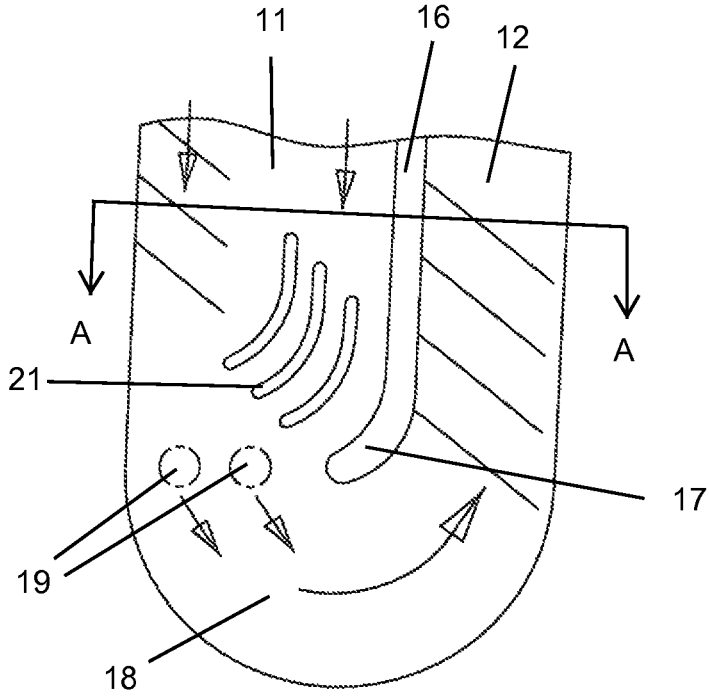
FIG. 6 shows a cross section close-up view of the bleed holes and inner root turn channel of the vane of the present invention.

FIG. 6 shows a detailed view of the lower end of the first leg 11 and the root turn channel 18 with the turning guide rib 17 and the additional guide ribs 21 that direct the cooling air from the aft section of the first leg 11 to mix with the hotter cooling air and flow into the bleed hole or holes 19 and into the ISSH.

Figure 7:
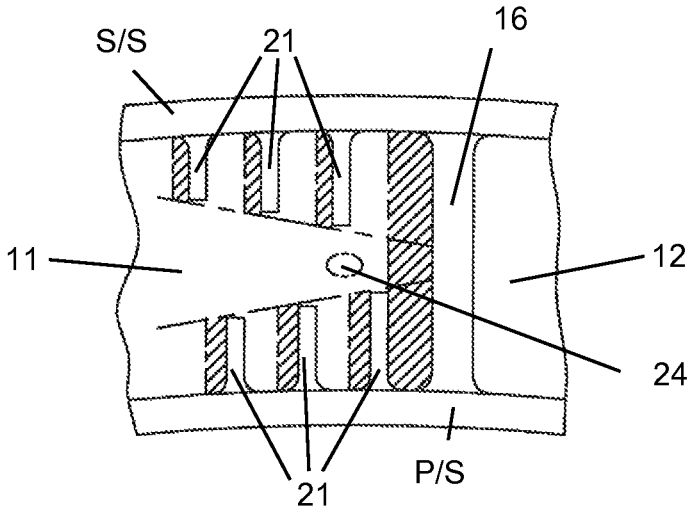
FIG. 7 shows a cross section view of the leading edge channel and the turning guide vanes through the line A-A in FIG. 6 of the present invention.

FIG. 7 shows a top view of the root turn channel along the line A-A in FIG. 6 with the partition rib and the guide ribs that direct the cooling air into the bleed hole or holes 19. The partition rib 16 separates the first leg 11 from the second leg 12. The additional guide ribs 21 are shown with the cross hatching on the forward sides of the guide ribs representing the curved parts of the guide ribs. The guide ribs 21 extend out from the walls of the first leg channel 11 to form a gap between guide ribs in a center of the channel 11. As seen in FIG. 7, the guide ribs 21 extend from the P/S wall surface of the first leg and from the S/S wall surface in a staggered and cascading formation. The guide ribs 21 have shorter extensions the further away from the partition rib 16, or in other words the gaps between guide ribs grows larger the further away from the partition rib 16 the guide ribs 21 are. Located within the root turn and near to the partition ribs 16 is an instrumentation hole 24 in which a temperature sensor can be inserted into the root turn channel for measurements.

I claim the following:

1. An air cooled industrial turbine stator vane comprising:
- a leading edge region and a trailing edge region;
- a serpentine flow cooling circuit with a first leg located along the leading edge region of the vane;
- a partition rib separating the first leg from a second leg of the serpentine flow cooling circuit;
- a root turn channel connecting the first leg to the second leg of the serpentine flow cooling circuit;
- a bleed hole located near to a junction between the first leg and the root turn channel that opens into an inter-stage seal housing; and,
- a lower end of the partition rib having a curvature to direct cooling air from an aft section of the first leg toward the bleed hole.

2. The air cooled industrial turbine stator vane of claim 1, and further comprising:
- a forward section of the first leg has trip strips along its side wall; and,
- an aft section of the first leg has smooth walls without any trip strips.

3. The air cooled industrial turbine stator vane of claim 1, and further comprising:
- a guide rib separate from the turning rib and located at an end of the first leg in an aft section of the first leg and shaped to direct cooling air from the aft section of the first leg toward the bleed hole.

4. The air cooled industrial turbine stator vane of claim 1, and further comprising:
- a plurality of guide ribs separate from the turning rib and located at an end of the first leg in an aft section of the first leg and shaped to direct cooling air from the aft section of the first leg toward the bleed hole.

5. The air cooled industrial turbine stator vane of claim 3, and further comprising:
- a plurality of guide ribs each extending from a pressure side wall surface or a suction side wall surface of the first leg.

6. The air cooled industrial turbine stator vane of claim 5, and further comprising:
- a gap is formed between guide ribs that extend from the pressure side surface and the suction side surface of the first leg.

7. The air cooled industrial turbine stator vane of claim 6, and further comprising:
- the gaps between guide ribs progressively increases in a direction away from the partition rib.

* * * * *